United States Patent [19]

Hellmig et al.

[11] 4,023,970

[45] May 17, 1977

[54] LIGHT-SENSITIVE COLOR PHOTOGRAPHIC MATERIAL WITH MASKING LAYER COMPRISING SPONTANEOUSLY SILVER HALIDE

[75] Inventors: Ehrhard Hellmig; Erwin Ranz, both of Leverkusen, Germany

[73] Assignee: AGFA-Gevaert, A.G., Leverkusen, Germany

[22] Filed: Apr. 28, 1975

[21] Appl. No.: 571,959

[30] Foreign Application Priority Data

May 2, 1974 Germany ..... 2421068

[52] U.S. Cl. ..... 96/6; 96/22; 96/74

[51] Int. Cl.² ..... G03C 7/04; G03C 1/76; G03C 7/16

[58] Field of Search ..... 96/7, 74, 69, 72, 73, 96/6, 22

[56] References Cited

UNITED STATES PATENTS

| | | | |
|---|---|---|---|
| 2,253,070 | 8/1941 | Evans | 96/7 |
| 2,319,369 | 5/1943 | Sease | 96/22 |
| 3,148,062 | 9/1964 | Whitmore et al. | 96/74 |
| 3,227,554 | 1/1966 | Barr et al. | 96/22 |
| 3,364,022 | 1/1968 | Barr | 96/74 |

FOREIGN PATENTS OR APPLICATIONS

| | | | |
|---|---|---|---|
| 547,519 | 12/1941 | United Kingdom | 96/7 |

*Primary Examiner*—David Klein
*Assistant Examiner*—Richard L. Schilling
*Attorney, Agent, or Firm*—Connolly and Hutz

[57] ABSTRACT

A light-sensitive color photographic material comprises four silver halide emulsion layer units, one for recording each of the yellow, magenta and cyan partial images and one which serves as a color correction layer. The latter mentioned silver halide emulsion layer is fogged, has a lower light-sensitivity than the light-sensitive partial image recording layer, and contains color couplers for producing a yellow to magenta masking image to compensate for the undesired side densities in at least two image recording layers.

9 Claims, No Drawings

LIGHT-SENSITIVE COLOR PHOTOGRAPHIC MATERIAL WITH MASKING LAYER COMPRISING SPONTANEOUSLY SILVER HALIDE

This invention relates to a light-sensitive colour photographic multi-layered material with built-in means for the automatic colour correction of unwanted colour side densities in the image dyes.

It is well known that, when a negative multi-layered colour film is copied on to a positive multi-layered colour film or on to colour copying paper, a certain falsification of colour sets in, due to the optical imperfections of the image dyes, that is to say the so-called side densities of these dyes (also referred to in sensitometric terms as "side gradations").

As is known, so-called "masks" are used to eliminate these faults in colour reproduction. These masks are images which are opposite in gradation to the image of a particular colour which is required to be corrected (partial colour image; yellow, magenta or cyan colour in three-layered materials) but which have a flatter gradation than the image which is to be corrected and a different colour. For optimum colour correction, the masking image should correspond both in colour and in magnitude of gradation (the latter being opposite in direction in the masking image) to the unwanted image of the side colour density in the partial image which is required to be corrected. Thus for example a magenta dye of which the side gradation of 0.30 in the blue spectral region (yellow image) is required to be eliminated by masking requires a masking image with an opposite gradation of 0.30 and yellow colour.

In modern multi-coloured films, the means for such masking are incorporated when the film is produced (so-called built-in masks or integral masks). They automatically come into effect when the film is exposed and subsequently processed in the photographic baths (therefore also known as automatic masks).

These modern masking processes are mostly based on the use of coloured couplers which recouple to another colour (the so-called image colour) after exposure and photographic processing, so that the original colour of the coupler disappears to the required extent. Thus for example a coupler for producing a magenta image is yellow in colour if it is required to compensate for the side density in the blue third of the spectrum.

The use of coloured masking couplers for the production of colour films has, however, serious disadvantages. Since these couplers can never be used on their own because of their strong colour but must always be mixed with at least one corresponding colourless coupler, colour development of such a two-component or multi-component system is always accompanied by competing reactions owing to the differing coupling velocities of the various couplers. These competing reactions modify the desired masking gradation (non-linear relationship between masking gradation and image gradation), thereby having a deleterious effect on the colour reproduction in the copy. In addition, the incorporation of such masking couplers often requires special methods which render the preparation of the light-sensitive emulsions more difficult, apart from the fact that the necessity to prepare and keep in storage both a coloured coupler and a colourless coupler in itself constitutes an additional complication.

Added to this is one fundamental difficulty: according to the principle of coloured couplers, only certain side gradations of certain image dyes can be masked since the colour of the coupler absorbs actinic light (this absorption varies from case to case), whereby the sensitivity of the underlying image layer or layers is reduced. Thus for example a magenta coupler which is cyan or green in colour would reduce the red sensitivity of the layer which contains the cyan coupler whereas a yellow coupler which is red in colour would reduce the green sensitivity of the magenta layer. Although such coloured masking couplers would be necessary for masking the side density of the magenta dye in the red region of the spectrum and for masking the side density of the yellow dye in the green region of the spectrum, in practice they are impossible to use in films of high light sensitivity because, with the ever increasing requirements for light sensitivity in photographic materials, it is essential to avoid any factor which has a deleterious effect on this property.

Another disadvantage of this method of masking unwanted side densities lies in the great difficulty of preparing masking couplers which have the desired colour.

Another known masking process, which uses the so-called inter-image effect, is free from these difficulties but it has other serious disadvantages which seriously restrict its practical possibilities. In this process, one or more individual layers of a multi-layered material are given a latent fog so that the layer will develop spontaneously. If at least one of the two other individual layers is exposed imagewise and developed in the usual manner, the development kinetic processes which take place in and between the individual layers of the colour film will have the effect that, in the latently fogged layer, an image will be produced only in those areas which correspond to the unexposed areas of the adjacent layer because development is inhibited in the areas corresponding to the exposed areas of the adjacent layer. In the latently fogged layer there will therefore be produced an image which is opposite in gradation to the image in the layer which has been exposed imagewise, i.e. a mask for this exposed layer is obtained. Since it will be clear from what has been said above that this process is not restricted to the use of coloured couplers, the light losses and hence sensitivity losses due to the colour of these couplers are eliminated. Since no special couplers other than the usual colourless couplers are required, this process has the advantage of being very simple and economical.

Since it will be clear from what has been said above that this process is not restricted to the use of coloured couplers, the light losses and hence sensitivity losses due to the colour of these couplers are eliminated. Since no special couplers are required, this process has the advantage of being very simple and economical.

In its practical application, however, this principle is severely restricted, since the fogging of one or more of the individual colour photographic layers which, after all, are also required to register the corresponding partial colour image reduces the light sensitivity of these individual layers, and all the more so the higher the density of this fog after chromogenic development. To this comes the added difficulty that colour negative films basically have a flat gradation, generally between 0.55 and 0.70, so that the sensitivity loss due to fogging is particularly serious. For the most highly sensitive films, therefore, this known process could only use fogs of low density, i.e. up to about 0.20 and hardly hgher than the natural fog of the given individual emulsion layer. This means that only very flat masks can be produced on this principle although the interferring side densities of certain image dyes are sometimes substantially higher and therefore cannot be masked on this principle. It is then again necessary to use additional aids for masking these side densities, in particular coloured couplers, so that the desired advantages are again lost.

It is also known to mask unwanted side colour densities of the individual partial colour images by associating each of the light-sensitive layers provided for producing the partial colour image with a fogged silver halide emulsion layer which contains one or two colour couplers for producing dyes for masking images, each of these coulers having the colour corresponding to the side density which is required to be masked, and by incorporating in the given light-sensitive silver halide emulsion a colour coupler which liberates a diffusing development inhibitor in the colour coupling reaction. The development inhibitor which diffuses imagewise produces in the fogged silver halide emulsion a positive coloured masking image composed of one or two dyes, each of which compensates for one of the two side densities of the image dyes formed in the associated light-sensitive silver halide emulsion layer. The action of each development inhibitor is restricted to its associated fogged silver halide emulsion layer by arranging barrier layers of silver chloride between the layer units provided for producing the partial colour images. It is obvious that this results in a complicated photographic structure with a large number of layers, which is very difficult and expensive to produce.

It is an object of this invention to provide a simple colour photographic material which is colour corrected by the incorporation of automatic masks. It has been found that, with suitable choice of colour coupler and its quantity, a single masking layer is capable of compensating for the unwanted side colour densities in two or even all three partial colour images of a colour photographic multi-layered material.

This invention relates to a light-sensitive colour photographic material comprising four silver halide emulsion layer units one of which is predominantly sensitive to red light and has associated with it a colourless coupler for producing the cyan partial colour image, another of which is predominantly sensitive to green light and has associated with it a colourless coupler for producing the magenta partial colour image, and a third which is predominantly partial colour image, and a third which is predominantly sensitive to blue light and has associated with it a colourless coupler for producing the yellow partial colour image, the image dyes in at least two of the partial colour images having unwanted side densities. According to the invention, the colour photographic material is characterised in that the fourth silver halide emulsion layer, which serves as colour correction layer for masking the unwanted side densities in at least two partial colour images, has been fogged to be spontaneously developable, has a lower sensitivity than that light-sensitive silver halide emulsion layers provided for producing the partial colour images, and has associated with it at least one colourless coupler for produceing a yellow to magenta masking image.

The term "associated" is used in the context of this application to indicate that there is a relation between the silver halide emulsion layer and the colour coupler associated with it which allows a colour image to be formed from the associated colour coupler which is in correspondence to the silver image formed from the silver halide during development. To achieve this effect the colour coupler is usually incorporated directly in the silver halide emulsion layer. But for one reason or the other, the colour coupler may also be contained in a binder layer adjacent to the silver halide layer. Although the first mentioned embodiment is generally preferred because of the reduced number of layers constituting the photographic material this description and the claims are not to be construed to be limitative to it.

According to the invention, the colour photographic material has only one masking layer, consisting of a fogged silver halide emulsion and having associated with it one or preferably several colour couplers for producing the masking image. The colour of the colour mask formed in the fogged layer depends, in accordance with the usual rules of masking techniques, on the side densities which are to be masked. If, for example, it is required to mask to side densities of the cyan partial colour image (yellow, magenta) and the side densities of the magenta partial colour image (yellow, cyan), then the fogged silver halide emulsion layer must contain colour couplers which, on chromogenic development produce a colour mask which has the appropriate densities in all three thirds of the spectrum, namely a certain proportion of each of the densities yellow, magenta and cyan. If in addition it is required to mask the magenta side density of the yellow partial colour image (the cyan side density of this partial colour image is usually negligible) then the colour mask produced in the masking layer must have a correspondingly large proportion of magneta. When the usual magenta couplers are used, the cyan side density of the magenta partial colour image is generally considerably lower than the corresponding yellow side density. This explains why the colour of the colour mask consists substantially of yellow and magenta portions and has only a small cyan portion if any.

In principle, such a mask can be produced with a single colour coupler if it obeys the above conditions, i.e. if it gives rise to a yellow to magenta dye, e.g. a red or orange-red dye. It is much easier, however, to use a mixture of several colour couplers in the fogged silver halide emulsion layer so that, on chromogenic development, dyes with main densities in various thirds of the spectrum are obtained. In that case it is easier to adjust the mask to the side densities produced by the given colour couplers used for recording the image simply by varying the proportions in which the individual couplers are used in the masking layer, so that optimum masking can be achieved. The masking emulsion may therefore in principle be prepared from the same colour couplers as those present individually in the image recording layers. For example, the masking layer may contain a yellow coupler and a magenta coupler and, if indicated, also a cyan coupler.

The masking fog can be adjusted to the required density for masking by known methods, e.g. by adjusting the quantity of the latently fogged silver halide and/or the quantity of colour coupler and, particularly, the thickness of the masking layer to the required value. This value is in principle no longer limited upwardly in the material according to the invention and without affecting the sensitivity of any individual layer of the colour film it may lie far above 0.20 density units which was the maximum permissible in previous processes. For practical reasons, a range of 0.20 to 1.00 is preferably (ASA Stand. PH 2,1–1952).

According to a preferred embodiment for producing the mask, the same emulsion, including its additives, is used as for producing one of the partial colour images, the only difference being that the emulsion used for the masking layer is, in addition, fogged to be developable and may contain additional colour couplers.

Latent fogging of the emulsion layer may be carried out in known manner, e.g. by chemical reduction or by exposure to light or by a combination of such methods. Fogging may be carried out at any stage in the preparation of the emulsion or of the photographic material. In the latter case, for example, the masking layer is arranged between the support layer and the red-sensitive layer and fogged, for example, by exposure to light, before the other light-sensitive layers are applied.

Chemical fogging is generally carried out before the emulsion is cast. For example, a $10^{-2}$ molar aqueous solution of formamidine sulphinic acid is added to the casting solution in a certain quantity per g of silver nitrate at pH 6.8 and pAg 9 and the solution is then digested for 15 minutes at 40° C.

The light sensitivity of the masking layer may vary within wide limits. In principle, the material according to the invention would have the desired effect even if the masking layer were not sensitive or only very slightly sensitive to light. No recording of the image would then take place even in the lightest area of the object. For such a case, there is no lower limit to the sensitivity of the masking layer which may be employed and there is no limit to the fineness of grain of the silver salt emulsion, which need not be spectrally sensitised. On the other hand, the masking layer may still have a certain sensitivity to light and this may be so high that, in certain areas of the image, upwards of a certain brightness, image recording takes place to assist the image recording in one of the three highly light-sensitive individual layers in which the yellow, magenta or cyan partial image is recorded.

The invention is capable of numerous variations. The separate masking layer is not confused to a particular position within the combination of layers. Masking due to vicinal effects always takes place even if the masking layer is arranged in extreme positions (an uppermost or lowermost layer). It is preferred to arrange the masking layer directly adjacent to the lowermost image recording layer, in particular between the latter and the support. In the usual sequence of layers in modern three-layered negative colour films, this would be below the red-sensitive layer for the cyan partial image. Unwanted scattering of light on the masking layer, which would have a deleterious effect on the sharpness of the image, is thereby substantially avoided. However, the masking layer could equally well be arranged between the red-sensitive and the green-sensitive image recording layer.

According to one particularly preferred embodiment, the masking layer is combined with another, light-insensitive layer of the colour film, for example an intermediate gelatine layer or a protective layer on the top of the film or a so-called filter yellow layer, a colour filter layer or even the antihalation layer provided it is on the same side of the support as the masking layer.

A single mask is thus capable of correcting the colour falsifying effect of the side colour densities of all three partial colour images. If slight unwanted residual graduations still remain, either because masking has been isufficient or because it has been excessive, these can be corrected by changing to other colour couplers which give rise to image dyes with correspondingly lower (in the case of insufficient masking) or higher side densities (in the case of excessive masking). If such colour couplers are not available, the side densities of overmasked image dyes can be adjusted to each other by the addition of a small amount of a colour coupler of the appropriate colour until all the side densities have been completely masked.

The image recording silver halide emulsion layer units of the material according to the invention, particularly the red-sensitised and/or green-sensitised silver halide emulsion layer, may consist of two partial layers as described, for example, in German Pat. No. 1,121,470. The two partial layers of an image recording layer unit have basically the same function, i.e. they record light of the same spectral region and produce image dyes of the same colour. In other words, the two partial layers have the same spectral sensitisation and contain the same or similar colour couplers so that they contribute to the same partial colour image. One of the two partial layers may advantageously have a higher sensitivity and produce a lower maximum colour density than the other.

The masking process according to the invention is based on utilisation of the iner-image effect, according to which the development processes in one silver halide emulsion layer, in this case particularly in the fogged layer, are materially influenced by the development processes in the adjacent light-sensitive layers. In particular, development of the fog is controlled by the strength of development of the corresponding image areas in adjacent layers, and the effects produced by the individual image recording layers are superimposed on each other in the masking layer. It is clear that the masking process according to the invention is particularly easily carried out if compounds which liberate diffusing development inhibitors on development are used in the light-sensitive silver halide emulsion layers.

Such compounds which liberate development inhibitors include, for example, the known DIR-couplers (DIR = development inhibitor releasing) which are colour couplers which contain a removable substituent in the coupling position, this substituent being removed from the coupler molecule when colour coupling takes place, a dye being formed from the coupler molecule residue at the same time. DIR couplers of this kind have been described, for example, in U.S. Pat. Specification No. 3,227,554.

Particularly suitable, however, are those development inhibitor releasing compounds which react with colour developer oxidation products to liberate a development inhibitor without at the same time forming a dye. Such compounds, which may be referred to as DIR compounds in contrast to the DIR couplers, have been described, for example, in U.S. Pat. Specification No. 3,632,345.

The masking process according to the invention is, however, by no means dependent on the presence of DIR-couplers or DIR-compounds.

If complete masking of all unwanted side densities cannot be achieved in accordance with the present invention, further improvement can be achieved by combining the masking process according to the invention with known masking methods. The known coloured masking couplers should be particularly mentioned in this connection. The disadvantages mentioned above in connection with these coloured masking couplers are now no longer important because the side densities in question are now only slight, if indeed they require any further masking, so that only low concentrations of colour masking couplers are required and the colour density of the unprocessed material will be correspondingly low.

The light-sensitive silver halide emulsion layers of the photographic material according to the invention have differing spectral sensitivities and each layer contains at least one non-diffusing colourless colour coupler for producing an image dye in a colour which is usually complementary to the spectral sensitivity. The red-sensitive layer normally contains at least one non-diffusable colour coupler for producing the cyan partial colour image, generally a coupler of the phenol or $\alpha$-naphthol series. The green-sensitive layer normally contains at least one non-diffusible colour coupler for producing the magenta partial colour image, generally a colour coupler of the 5-pyrazolone or indazolone series. The blue-sensitive layer unit, lastly, normally contains at least one non-diffusible colour coupler for producing the yellow partial colour image, generally a colour coupler with an open chain ketomethylene group, but other arrangements of colour couplers in relation to the spectral sensitivites could also be used. Large numbers of colour couplers of these kinds are known and have been described in numerous Patent Specifications. Reference may be made, for example, to the publication entitled "Farbkuppler" by W. Pelz in "Mitteilungen auf den Forschungslaboratorien der Agfa, Leverkusen/Munchen," Volume III (1961), and to K. Venkataraman, "The Chemistry of Synthetic Dyes," Vol. 4, p. 341–387, Academic Press 1971.

The non-diffusible colourless colour couplers and, if used, the non-diffusible coloured masking couplers as well as the non-diffusing compounds which release a development inhibitor are added to the light-sensitive silver halide emulsions by the usual, well-known methods. If the compounds are water-soluble or alkali-soluble, they may be added to the emulsions in the form of aqueous solutions, optionally with the addition of organic solvents which are miscible with water, such as ethanol, acetone or dimethylformamide. If the non-diffusible colour couplers and the non-diffusible compounds which release development inhibitor are insoluble in water or alkalis, they may be emulsified in known manner, e.g. by mixing a solution of these compounds in a low-boiling organic solvent directly with the silver halide emulsion or first mixing it with an aqueous gelatine solution and evaporating off the organic solvent. The emulsion of the compound in gelatine obtained in this way is then mixed with the silver halide emulsion. If desired, emulsification of such hydrophobic compounds may be assisted by the addition of so-called coupler solvents or oil-forming agents, which are generally higher boiling organic compounds which enclose the non-diffusible colour couplers which are to be emulsified in the silver halide emulsions and the development inhibitor releasing compounds in the form of oily droplets. Reference may be had in this connection e.g. to U.S. Pat. Specification Nos. 2,322,027; 3,689,271; 3,764,336 and 3,765,897.

The usual silver halide emulsions may be used for the present invention. They may contain silver chloride, silver bromide or mixtures thereof, optionally with a small silver iodide content of up to 20 mols-%.

The binder used for the photographic layers is preferably gelatine although this may be partly or completely replaced by other natural or synthetic binders. Suitable natural binders include e.g. alginic acid and its derivatives such as salts, esters or amides, cellulose derivatives such as carboxymethyl cellulose, alkyl celluloses such as hydroxyethyl cellulose, starch or its derivatives such as ethers or esters or caragenates. Suitable synthetic binders include polyvinyl alcohol, partially saponified polyvinyl acetate and polyvinyl pyrrolidone. The emulsions may also be chemically sensitised, for example by adding sulphur compounds such as allyl isothiocyanate, allyl thiourea and sodium thiosulphate at the stage of chemical ripening. Reducing agents may also be used as chemical sensitisers, e.g. the tin compounds described in Belgian Pat. Specifications Nos. 493,464 or 568,687; polyamines such as diethylene triamine or aminomethane sulphinic acid derivatives, e.g. according to Belgian Pat. Specification No. 547,323, may also be used.

Noble metals such as gold, platinum, palladium, iridium, ruthenium or rhodium and compounds of these metals are also suitable chemical sensitisers. This method of chemical sensitisation has been described in the article by R. KOSLOWSKY, Z. Wiss. Phot. 46, 65 – 72 (1951).

The emulsions may also be sensitised with polyalkylene oxide derivatives, e.g. with a polyethylene oxide which has a molecular weight between 1,000 and 20,000, or with condensation products of alkylene oxides and aliphatic alcohols, glycols or cyclic dehydration products or hexitols with alkyl-substituted phenols, aliphatic carboxylic acids, aliphatic amines, aliphatic diamines and amides. The condensation products have a molecular weight of at least 700, preferably more than 1000. These sensitisers may, of course, also be combined to achieve special effects as described in Belgian Pat. Specification No. 537,278 and in British Pat. Specification No. 727,982.

The emulsion may also be spectrally sensitised, e.g. with the usual monomethine or polymethine dyes such as acid or basic cyanines, hemicyanines, streptocyanines, merocyanines, oxonols, hemioxonols, styryl dyes, etc. or trinuclear or multi-nuclear methine dyes, for example rhodacyanines or neocyanines. Sensitisers of this kind have been described, for example, in the work by F. M. HAMER "The Cyanine Dyes and Related Compounds" (1964), Interscience Publishers John Wiley and Sons.

The emulsions may contain the usual stabilisers, e.g. homopolar or salt-type compounds or mercury which contain aromatic or heterocyclic rings such as mercaptotriazoles, simple mercury salts, sulphonium mercury double salts and other mercury compounds. Azaindenes are also suitably used as stabilisers, preferably tetra- or pentaazaindenes and especially those which are substituted with hydroxyl or amino groups. Compounds of this kind have been described in the article by BIRR, Z. Wiss. Phot. 47, 2 – 58 (1952). Other suitable stabilisers include heterocyclic mercapto compounds such as phenyl mercaptotetrazole, quaternary benzothiazole derivatives, benzotriazole and the like.

The emulsions may be hardened in the usual manner, for example with formaldehyde or halogen-substituted aldehydes which contain a carboxyl group, such as mucobromic acid, diketones, methane sulphonic acid esters, dialdehydes carbodiimides, carbonylpyridinium salts and carbamoyloxypyridinium salts.

Examples

Light-sensitive photographic material:

Arrangement of layers

Support: a transparent support layer of cellulose triacetate a. intermediate gelatine layer,
b. cyan layer containing a red-sensitised silver halide emulsion and a cyan coupler,
c. intermediate gelatine layer,
d. magenta layer containing a green-sensitised silver halide emulsion and a magenta coupler,
e. intermediate gelatine layer,
f. yellow filter layer,
g. yellow layer containing a blue-sensitive siver halide emulsion and a yellow coupler,
h. protective gelatine layer.

The material is hardened in the usual manner, e.g. with tris-acryloyl-hexahydrotriazine.

The following compounds are used as colour couplers both for the individual image layers and for the masking layer according to the invention:

yellow coupler

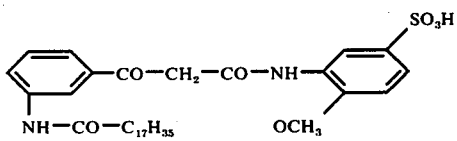

magneta coupler

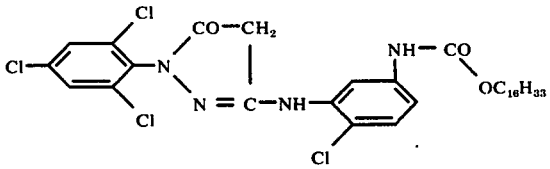

cyan coupler

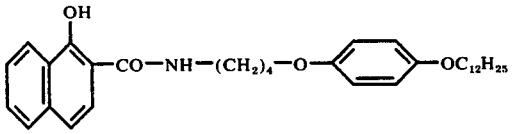

The yellow coupler is used in the form of a 5% solution of the coupler in an 8% aqueous gelatine solution.

The magenta coupler and the cyan coupler are used in the form of an emulsion which contains 5% by weight of coupler and which has been obtained by dispersing a mixture of equal parts of coupler and di-n-butyl phthalate in a 10% aqueous gelatine solution.

Masking layer 10 ml of a 1% solution of 1,3,3*a*,7-tetraaza-4-hydroxy-6-methyl indene in methanol.
48 ml of a 10% aqueous gelatine solution,
220 ml of water,
15 g of the emulsion of magenta coupler,
15 g of solution of yellow coupler and
4 g of the emulsion of cyan coupler are added to 60 g of a relatively insensitive silver halide gelatine emulsion in which the silver halide consists of 98 mols-% of silver bromide and 2 mols-% of silver iodide and which has been fogged as described below.

Fogging

The silver halide was fogged by chemical treatment before the other constituents of the casting solution for the masking layer were added. Fogging was carried out by adding a $10^{-2}$ molar solution of formamidine sulphinic acid in water in a quantity of 0.1 ml per 1 g of silver nitrate at pH 6.8 and pAg 9 and then digesting for 15 minutes at 40° C.

Processing

The material is exposed to blue, green and red light through the appropriate colour separation filters behind a grey step wedge in a conventional sensitometer and the exposed material is developed in a colour developer of the following composition:

2 g of the sodium salt of isopropanol diaminotetraacetic acid,
30 g of potassium carbonate
4 g of potassium sulphite,
1.5 g of potassium bromide,
2 g of hydroxylamine and
5 g of colour developer of the following formula

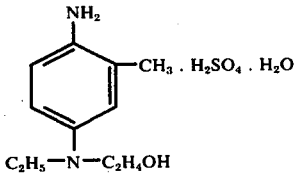

made up to 1 liter.

Development: 5 minutes at 25° C.

The subsequent processing stages described below take each 8 minutes. The baths are again employed at a temperature of 25° C.

Short stop bath:
30 ml of acetic acid (concentrated)
20 g of sodium acetate
water up to 1 liter
Washing
Bleaching bath:
100 g of potassium ferricyanide
15 g of potassium bromide
water up to 1 liter
Washing
Fixing bath:
20% solution of sodium thiosulphate
Final washing.

Masking measurements

The image dyes produced in the silver halide emulsion layers for the yellow, magenta and cyan partial image have the main and side densities summarised in the following table when the said couplers are used. The main densities were set at 1.00. The interfering side densities of the image dyes were determined on separately cast emulsion layers.

In the following table, the first line shows the colours of the partial image dyes and the first column indicates the filters used for carrying out the measurements.

| | Yellow | Magenta | Cyan |
|---|---|---|---|
| blue[1] | 1.00 | 0.25 | 0.05 |
| green[2] | 0.15 | 1.00 | 0.11 |
| red[3] | 0.00 | 0.07 | 1.00 |

[1]measuring filter Schott BG 12
[2]measuring filter Schott VG 9
[3]measuring filter Schott RG 2

The masking effects obtained in the arrangement of layers described above by incorporating the fogged masking layer are described below:

The fogged masking layer is incorporated in place of layer a in the multi-layered material; thickness of layer 3 $\mu$.

The following fog densities are obtained after processing:

magenta fog density 0.58 composed of
0.15 normal magenta fog in the magenta layer and
0.43 fog due to masking layer.

Yellow fog density 0.60 composed of
0.18 normal yellow fog in the yellow layer and
0.42 for due to masking layer.

Cyan fog density 0.20 composed of
0.10 normal cyan fog in the cyan layer and
0.10 fog due to the masking layer.

The values for masking of the magenta, yellow and cyan side densities entered in the following table are obtained from the above figures:

| | Yellow | Magenta | Cyan |
|---|---|---|---|
| blue | 1.00 | +0.08 | −0.07 |
| green | +0.03 | 1.00 | −0.01 |
| red | −0.03 | +0.02 | 1.00 |

It can be seen that there is a slight overmasking of those side densities which were originally slight, but this is acceptable in view of the considerable reduction of the original high side densities, e.g. the magenta side density of the yellow partial colour image and the yellow side density of the magenta partial colour image. By contrast, a corresponding material which contains no fogged colour correcting layer is found to have the following main densities and side densities if one takes into account the normal fog of the light-sensitive layers. These figures indicate only slight masking:

| | Yellow | Magenta | Cyan |
|---|---|---|---|
| blue | 1.00 | +0.22 | +0.03 |
| green | +0.14 | 1.00 | +0.10 |
| red | −0.01 | +0.05 | 1.00 |

The figures in the last two tables were not obtained from individual layers but from the complete layer combination in which the individual layers were exposed selectively, using the following colour separation filters: Agfa-Gevaert No. U 449 blue, No. U 531 green and No. L 622 red.

What we claim is:

1. A light-sensitive multi-layered colour photographic material consisting essentially of four silver halide emulsion layer units, one of which is predominantly sensitive to red light and has associated with it a colourless coupler for producing the cyan partial colour image, another of which is predominantly sensitive to green light and has associated with it a colourless coupler for producing the magenta partial colour image, and a third which is predominantly sensitive to blue light and has associated with it a colourless coupler for producing the yellow partial colour image, the image dyes in at least two of the partial colour images having unwanted side densities, and in which the fourth silver halide emulsion layer, which serves as a single colour correction layer for masking the unwanted side densities in at least two partial colour images, has been fogged to be spontaneously developable, has a lower sensitivity than the light-sensitive silver halide emulsion layers provided for producing the partial colour images and contains at least one colourless coupler for producing a yellow to magenta masking image.

2. A material as claimed in claim 1 in which the fogged silver halide emulsion layer contains a yellow coupler, a magenta coupler and a cyan coupler.

3. A material as claimed in claim 1 in which the masking fog has a density of from 0.20 to 1.00 density units.

4. A material as claimed in claim 1 in which the single masking layer is arranged directly adjacent to the lowermost image recording layer.

5. A material as claimed in claim 4 in which the single masking layer is arranged between the lowermost image recording layer and the support.

6. A material as claimed in claim 1 in which the masking layer is combined with an intermediate gelatin layer, a protective layer on top of the multilayered material, a filter yellow layer, a colour filter layer or an antihalation layer.

7. A material as claimed in claim 1 in which at least one of the light-sensitive silver halide emulsions contains a development inhibitor releasing coupler or compound.

8. The process of producing color corrected multicolor images comprising the step of simultaneously color developing in superimposed relationship a cyan, a magenta and a yellow partial color image and a yellow to magenta masking image, wherein the improvement comprises providing a light sensitive color photographic material essentially consisting of a support and in superimposed relationship spectrally sensitive silver halide emulsion layer units, one of which is predominantly sensitive to red light and has associated with it a colorless cyan-forming coupler, another of which is predominantly sensitive to blue light and has associated with it a colorless yellow-forming coupler, at least two of said red-sensitive, green-sensitive and blue-sensitive layer units having associated with them color couplers producing on chromogenic development image dyes which have unwanted side densities, providing in said light sensitive color photographic material a single additional silver halide emulsion layer which has a lower sensitivity than anyone of said red-sensitive, green-sensitive and blue-sensitive layer units, has been fogged to a degree that produces on chromogenic development a colour density of between 0.2 and 1.0 in said additional layer, and has associated with it at least one colorless coupler for producing on chromogenic development a yellow to magenta masking image, imagewise exposing said material and color developing said material, thereby producing simultaneously cyan, magenta and yellow partial color images in said red-sensitive, green-sensitive and blue-sensitive layer units and a yellow to magenta masking image in said single additional layer that compensates for the unwanted side densities of at least two of said cyan, magenta and yellow partial color images.

9. A light-sensitive multi-layered colour photographic material consisting essentially of four silver halide emulsion layer units, one of which is predominantly sensitive to red light and has associated with it a colourless coupler for producing the cyan partial colour image, another of which is predominantly sensitive to green light and has associated with it a colourless coupler for producing the magenta partial colour image, and a third which is predominantly sensitive to blue light and has associated with it a colourless coupler for producing the yellow partial colour image, the image dyes in at least two of the partial colour images having unwanted side densities, and in which the fourth silver halide emulsion layer, which serves as a single colour correction layer for masking the unwanted side densities in at least two partial colour images, has been fogged to be spontaneously developable, has a lower sensitivity than the light-sensitive silver halide emuslion layers provided for producing the partial colour images and contains a yellow coupler and a magenta coupler for producing a yellow to magenta masking image.

* * * * *